US012181260B2

(12) United States Patent
Lier et al.

(10) Patent No.: US 12,181,260 B2
(45) Date of Patent: Dec. 31, 2024

(54) PROGRESSIVE LOADING PRESS FOR AMMUNITION

(71) Applicant: Lyman Products Corporation, Middletown, CT (US)

(72) Inventors: Peter Vincent Lier, Hamden, CT (US); Richard Imbruglio, Portland, CT (US)

(73) Assignee: Lyman Products Corporation, Middletown, CT (US)

( * ) Notice: Subject to any disclaimer, the term of this patent is extended or adjusted under 35 U.S.C. 154(b) by 125 days.

(21) Appl. No.: 17/990,040

(22) Filed: Nov. 18, 2022

(65) Prior Publication Data

US 2024/0167799 A1 May 23, 2024

(51) Int. Cl.

| | |
|---|---|
| ***F42B 33/00*** | (2006.01) |
| ***F42B 3/04*** | (2006.01) |
| ***F42B 33/02*** | (2006.01) |
| ***F42B 33/04*** | (2006.01) |
| ***F42B 33/10*** | (2006.01) |

(52) U.S. Cl.

CPC ..... *F42B 33/001* (2013.01); *F42B 33/004* (2013.01); *F42B 33/005* (2013.01); *F42B 33/04* (2013.01); *F42B 33/10* (2013.01)

(58) Field of Classification Search

CPC ..... F42B 33/00; F42B 33/001; F42B 33/004; F42B 33/005; F42B 33/02; F42B 33/04; F42B 33/10

USPC ..... 86/23, 25, 27, 31, 32, 39, 40, 44

See application file for complete search history.

(56) References Cited

U.S. PATENT DOCUMENTS

| | | | | |
|---|---|---|---|---|
| 3,345,904 | A * | 10/1967 | Kleiss | F42B 33/0292 86/25 |
| 4,163,410 | A * | 8/1979 | Dillon | F42B 33/004 86/36 |
| 4,515,063 | A | 5/1985 | Lee | |
| 6,772,668 | B2 | 8/2004 | Shields | |
| 9,151,583 | B1 | 10/2015 | Stark et al. | |
| 9,664,488 | B2 | 5/2017 | Pruett et al. | |
| 9,879,961 | B2 | 1/2018 | Pruett et al. | |
| 9,982,982 | B2 | 5/2018 | Pruett | |
| 10,281,253 | B2 | 5/2019 | Stark et al. | |
| 10,619,984 | B2 | 4/2020 | Pruett et al. | |
| 10,753,717 | B2 | 8/2020 | Stark et al. | |
| 11,085,746 | B2 | 8/2021 | Carter et al. | |

(Continued)

OTHER PUBLICATIONS

Mark 7® Revolution User Manual v 2.0 (Nov. 24, 2020).

*Primary Examiner* — James S Bergin

(74) *Attorney, Agent, or Firm* — St. Onge Steward Johnston & Reens LLC; Stephen P. McNamara

(57) ABSTRACT

A progressive press for loading or reloading ammunition casings has a base containing a reversible press motor with speed control, and vertically-oriented nuts mechanically connected to the motor and having vertically-oriented power screws extending from the nuts. The screws are affixed to a tool head which can receive dies and other tools for loading and/or reloading ammunition casings. A rotatable shell plate receives ammunition casings and advances the casings through a series of operations performed by different dies and other tools. Using a control system, the press motor can be operated to extend the screws and lift the tool head when the shell plate is advanced, and to retract the screws and tool head to perform operations on the casings when the shell plate is stationary.

20 Claims, 17 Drawing Sheets

(56) References Cited

U.S. PATENT DOCUMENTS

| | | | | |
|---|---|---|---|---|
| 11,085,747 | B2 | 8/2021 | Pruett et al. | |
| 11,609,075 | B2 * | 3/2023 | Carter | F42B 33/0207 |
| 11,609,076 | B2 * | 3/2023 | Pruett | F42B 33/004 |
| 11,913,763 | B2 * | 2/2024 | Ball | F42B 33/10 |
| 2022/0026188 | A1 | 1/2022 | Findlay et al. | |
| 2022/0057183 | A1 | 2/2022 | Ball et al. | |
| 2022/0299301 | A1 * | 9/2022 | Lindsay | F42B 33/001 |
| 2024/0288255 | A1 * | 8/2024 | Lier | F42B 33/005 |

* cited by examiner

PROGRESSIVE LOADING PRESS FOR AMMUNITION

FIELD OF THE INVENTION

The present disclosure relates to the field of loading and reloading ammunition cartridges. More specifically, the technology relates to a progressive press for automated loading and reloading of ammunition.

BACKGROUND OF THE INVENTION

An ammunition cartridge typically includes a bullet (also called a projectile), a cylindrical casing or shell, a propellant (typically smokeless powder), and a primer. Generally, the bullet is cylindrical and has a hollow, round, pointed or flat point on one end. The other end of the bullet is flat or boat-tailed, fits the casing, and is held by the forward open end of the casing until the bullet is fired. The rear end of the casing has a washer shaped round rim. A hole or pocket in the center of the rim houses the primer. In use, the cartridge is held within the chamber of the firearm. When the bullet is discharged by a pin impacting the primer (each time the trigger of the firearm is pulled), the firearm can eject the spent casing and (in the case of semi-automatic operation) loads another, fresh cartridge into the chamber of the firearm.

OEM manufacturers of ammunition load new ammunition cartridges with a primer, propellant and bullet and sell them to shooting sports participants.

Individuals who are shooting sports enthusiasts often prefer to load or reload their own cartridges instead of purchasing commercially made new cartridges. Accordingly, such persons may purchase new casings and load them, or reload previously used casings. Loading and reloading allows the user to select the particular bullet, propellant and primer to suit the user's preferences. Reloading of spent casings with a new primer, powder and bullet is an economic alternative to purchasing new ammunition, and provides an enjoyable hobby.

A sequence of several steps is involved in reloading a spent cartridge or loading a new cartridge. The sequence must be followed carefully in order to produce a usable, reloaded cartridge safely. The steps of reloading typically involve:

- Mount empty casing in a press
- Remove any spent primer caps
- Casing resizing
- Casing trimming, and swage primer pocket
- Casing resizing
- Installing primer cap in primer pocket
- Casing mouth reaming/resizing, chamfer and size check
- Place measured powder charge in casing, and check powder quantity
- Seat bullet in casing mouth and crimp in place if needed The loading/reloading steps may be implemented using manual hand tools or manually activated or motorized presses.

In a single stage press, a single casing is held in a shell holder and is operated on by a die in a tool head; the casing is then removed and a new casing installed, and the operation is repeated on the new casing. When the operation has been completed on a series of casings, the die is changed to a different die which provides a different operation, and the operation is then repeated on each casing until the operation is completed on a series of casings. The die is then changed again and operations are repeated using the new die, and the sequence continues until all operations are completed on all casings. The limitation of a single state press is that it allows only a single die to be used at a time, proving a press operation on only one casing at a time.

In a turret press, a single casing is held in a shell holder and different dies on a revolving turret or tool head are sequentially positioned over the casing and the series of operations provided by the different dies are sequentially completed and the casing can be removed from the shell holder and a new casing installed which is then operated on by the different dies in sequence. The limitation of a turret press is that it allows operations on only one casing at a time.

A progressive press typically includes several processing stations arranged at fixed positions in a circle or a line. At each of the processing stations, one or more of the above mentioned steps of the sequence is performed simultaneously. A casing is sequentially advanced through the processing stations by movement of a shell plate which is indexed to the movement of dies and other operations components. As the casing is being subjected to each of the steps at the respective processing stations, other casings are typically being simultaneously processed in other steps of the sequence at the other processing stations. In preferred version of a progressive press, the a shell plate (a bed or casing holder) is a round plate with multiple semicircular cutouts around its peripheral edge that can receive and hold a casing that is to be processed in the progressive press. The shell plate rotates to move each casing between stations of the progressive press where operations such as the above listed steps can be completed.

In one known progressive press, the tool head (a die holder) having multiple dies or station operations can be maintained in a fixed, stationary position, and the shell plate is rotated and lifted up to the tool head where each station operation is performed. In another known progressive press, the shell plate rotates to sequentially position each casing in a station below a die position, and the tool head is driven downwardly to act on the casings held in the shell plate. In either version, multiple dies or operations can act on multiple casings simultaneously, thus improving throughput of the operations.

Each processing cycle step in a progressive press includes a processing segment and a relocating segment. During the processing segment of each of the cycles, one of the steps of the loading/reloading is performed. The relocating segment of each cycle follows the processing segment, and during the relocating segment all of the casings are moved simultaneously to the next station in the progressive press.

As suggested above, the processing cycles of a loading/reloading press may include different stations at which different operations may take place, which operations may include removing a spent primer, cleaning/re-sizing/swaging a primer pocket, inserting a primer, sizing the casing with a die, adding propellant, propellant amount check, adding a bullet, setting the bullet, crimping the casing to hold the bullet in place, and ejecting the finished cartridge from the press. Also as discussed above, each cycle of a loading/reloading press is accomplished through a reciprocating vertical movement of a tool head indexed to a shell plate which holds a plurality of casings.

However, these known systems and processes suffer from a number of drawbacks. Existing progressive presses typically have a vertically reciprocating lift mechanism which is a vertically reciprocating central ram that is actuated by a toggle linkage (similar to a crankshaft linkage), or a cam linkage, driven by a rotating motor shaft, as seen for example in U.S. Pat. No. 11,085,746, which shows a vertically reciprocating shell plate, or in the Mark 7 Apex 10 press which has a vertically reciprocating tool head.

Progressive presses using a toggle linkage must be very tall (and the cam driven linkages are nearly as tall) to provide room for the lift mechanism, which increases the cost of materials for the press as well as transportation costs and may make it difficult to conveniently position the press in some wok areas.

Progressive presses using a toggle or cam linkage can have problems with off-axis loading, particularly at high speeds. Off-axis loading can cause unintended deformation of a casing that is being processed, leading to poor precision and fit of the finished ammunition cartridge. As an example, if a bolt retaining the tool head to the ram has loosened, allowing the tool head to tilt or move, the movement of the tool head can cause off-axis loading on one or more casings. Off-axis loading can also arise if the force applied at different stations is sufficiently imbalanced that it causes the tool head, shell plate or casing to move or tilt. Even without an obvious problem of loose parts, there can be off-axis loading if the press operation changes the alignment and/or position of a tool head, shell plate or casing. For example, the force required to seat a bullet or to resizing a casing may be different, and both will certainly be different than the force required to seat a primer in a casing. Imbalanced forces applied may cause a sufficient movement or deformation to affect the quality of the finished cartridge. This problem may be aggravated if the shell plates and casings are located around the periphery of the press bed as this amplifies the problems of off-axis load on the entire assembly.

In order to avoid such problems, a manufacturer may opt to make the central ram and guide bushings, and also the toggle linkage and/or cam linkage and other components as high precision parts made from wear resistant materials, however, this increases the cost and effort needed to obtain a progressive press capable of maintaining a press bed that is consistently parallel to the tool head/die holder.

A further problem with known progressive presses is that they are not adjustable, and provide the same processing cycle to all sizes of casings, thus limiting the potential throughput of the progressive press to the throughput of the largest size ammunition cartridge accepted in the unit.

SUMMARY OF THE INVENTION

It is an objective of the present technology to provide a progressive press that provides a stable and consistent press force for loading and reloading of ammunition cartridges.

It is an objective of the present technology to provide a progressive press that can have a cycle travel and speed optimized for the particular size of the ammunition cartridges to be loaded or reloaded.

In accordance with one embodiment of the invention, a progressive press may include a base having a plurality of cavities; a plurality of nuts retained in the base, the nuts being aligned with the cavities; a plurality of screws provided in the plurality of nuts and extending through the cavities; a tool head affixed to upper ends of the screws; and a reversible press motor, mechanically connected to the nuts to cause rotation thereof, whereby operation of the press motor in one direction causes rotation of the nuts to cause upward travel of the screws to extend the tool head, and operation of the press motor in another direction causes reverse rotation of the nuts to cause downward travel of the screws to retract the screws and tool head. Preferably, the screws have a ram at their upper ends. Preferably, the screws are a lead screw or a ball screw, and the nuts are mating lead screw nuts or ball nuts. The nuts are synchronously mechanically coupled to and driven by the press motor. In one embodiment, the nuts each have a toothed pulley provided with each nut, and the press motor is provided with a toothed pulley, and a toothed belt, which is preferably double sided) connects the press motor toothed pulley to the nut toothed pulleys. Preferably, there are three ball screws and three nuts.

The tool head has a plurality of apertures adapted to receive dies and other tools for loading or reloading ammunition. The apertures may have mounted in them one or more dies including a primer decapping die, a hold down die, a sizing die for re-sizing a casing, a powder dropper, a neck expansion/flare die, and a bullet seating die and a bullet crimping die.

A circular shell plate that has a plurality of recesses around a peripheral edge thereof is located below the tool head and receives ammunition casings to be loaded/reloaded. As described above, the tool head can be retracted to position the tool head adjacent the shell plate or extended to position the tool head a distance above the shell plate. Shell plate movement is indexed to the extension and retraction of the tool head caused by extending and retracting of the screws. The shell plate is stationary when the screws are retracted, with a position of at least one recess in the shell plate aligned with a position of at least one aperture in the tool head. The shell plate is rotated during one or more of extension and retraction of the screws, to move the position of the least one recess in the shell plate to a position aligned with another aperture in the tool head. Preferably, rotation of the shell plate is driven by a shell plate motor which has a gear mounted to a drive shaft thereof, and the shell plate motor gear is engaged with and drives a ring gear provided on the lower surface of the shell plate.

A circular primer plate is rotated by a primer motor in indexed movement with the movement of the shell plate such that a primer is delivered to a position below a recess in shell plate for insertion into a primer pocket in the casing to be loaded/reloaded.

A control system provides integrated control of the press motor, shell plate motor, and primer motor including speed of the press motor revolutions and quantity of press motor revolutions. The control system thereby allows the user to set a selected maximum height and selected minimum height of the screws and tool head, the control the speed of the press, and to set various alarm conditions that might trigger a press stop. Alarm conditions may include a press motor torque over limit, a primer pocket swage rod force is either under or over a selected range, a powder charge quantity error, and others conditions.

Those skilled in the art will appreciate the many alterations possible to the presently described technology. The present technology is not limited to the embodiments and arrangements described above. Other objects of the present technology and its particular features and advantages will become more apparent from consideration of the following drawings and accompanying detailed description.

DETAILED DESCRIPTION OF THE INVENTION

Figure 1:
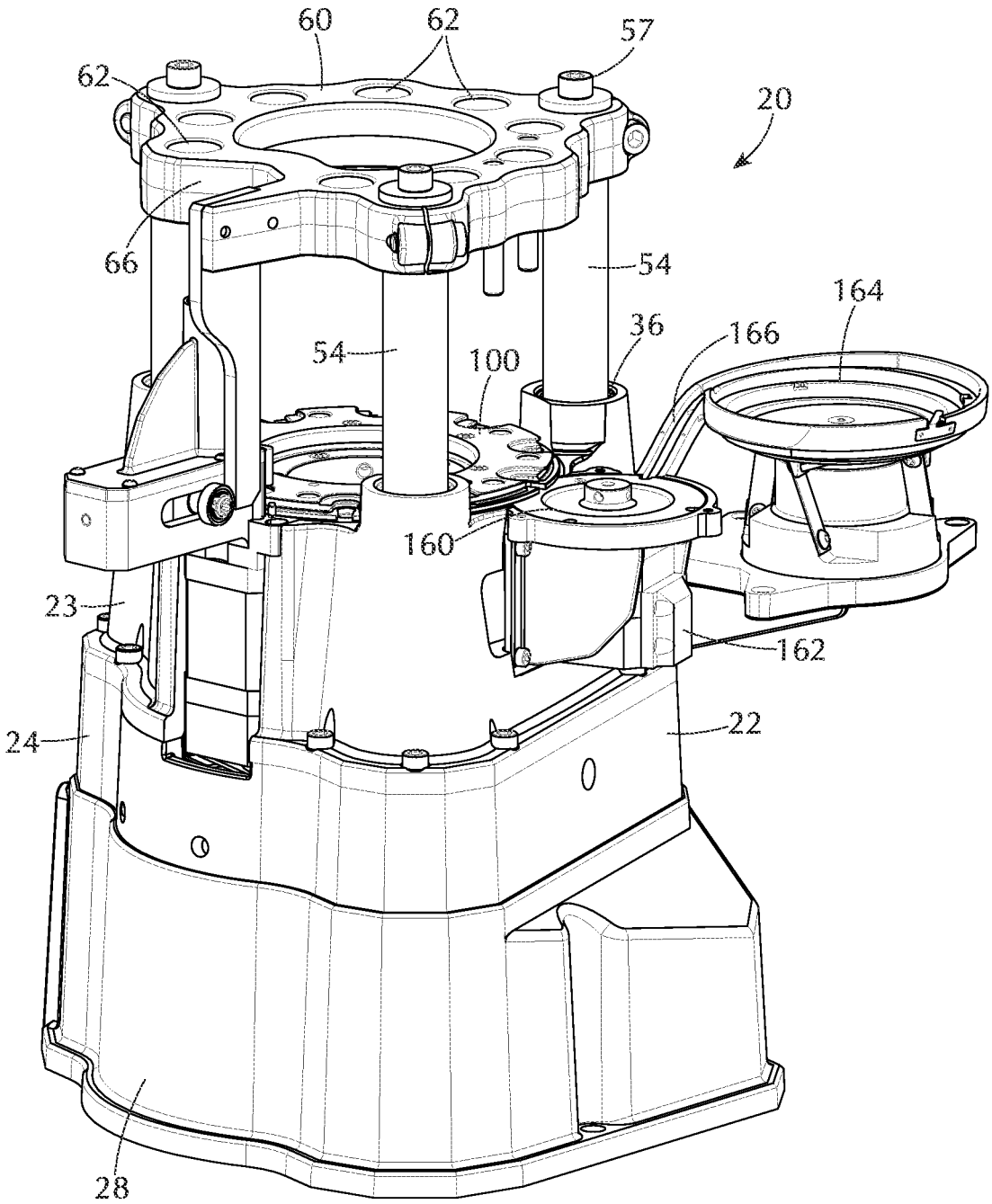
FIG. 1 is a top, front and left side perspective view of a progressive press in accordance with the invention with a tool head in a maximum raised position.
Figure 2:
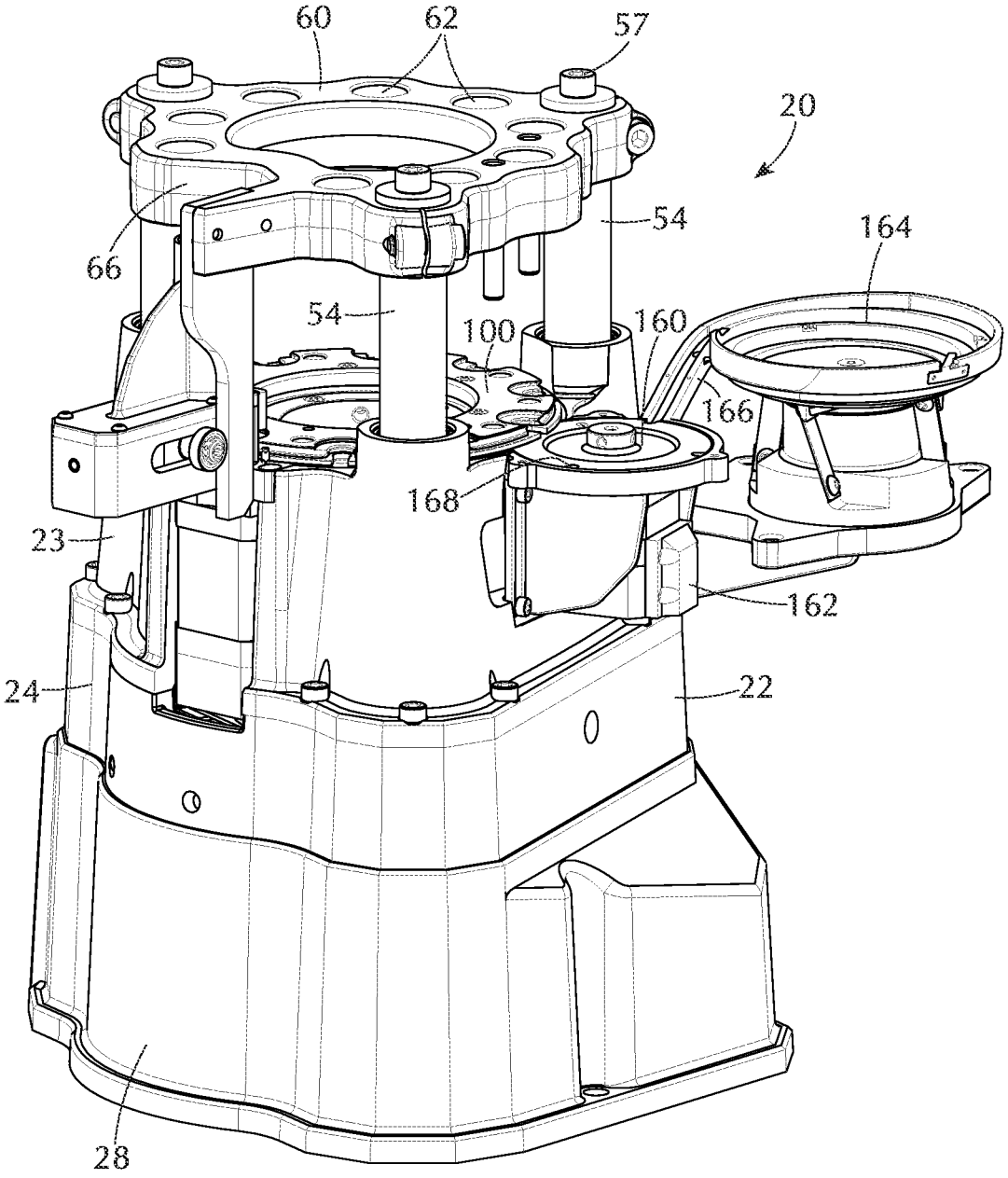
FIG. 2 is a top, front and left side perspective view of a progressive press in accordance with the invention with a tool head in a partial raised or partial retracted position.
Figure 3:
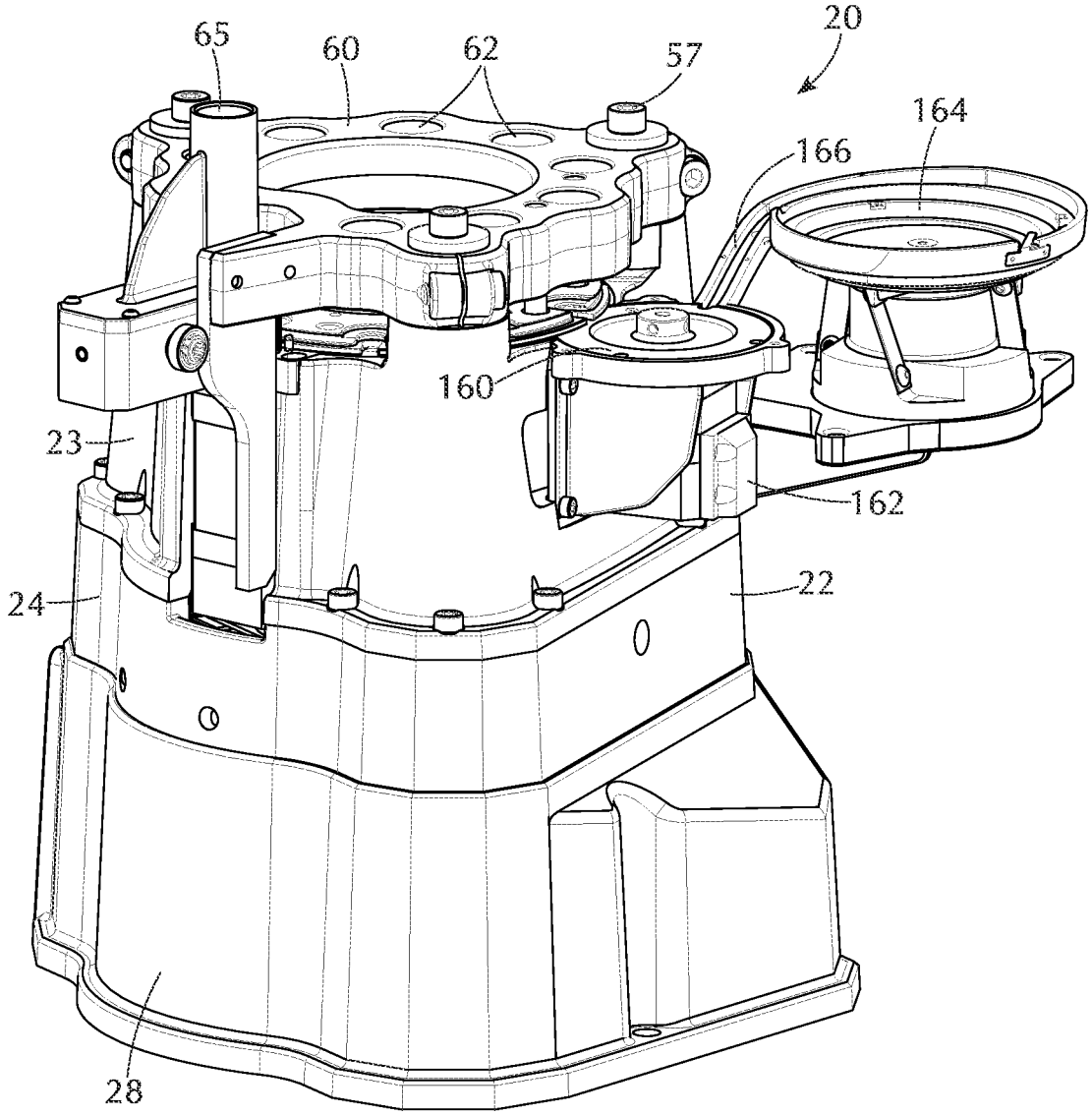
FIG. 3 is a top, front and left side perspective view of a progressive press in accordance with the invention with a tool head in a fully retracted position.

The following detailed description illustrates the technology by way of example, not by way of limitation of the principles of the invention. This description will enable one skilled in the art to make and use the technology, and describes several embodiments, adaptations, variations, alternatives and uses of the invention, including what is presently believed to be the best mode of carrying out the invention. One skilled in the art will recognize alternative variations and arrangements, and the present technology is not limited to those embodiments described hereafter. In the following description, the same element numbers shown in different drawings identify the same element.

Referring now FIGS. 1-16, and in particular, FIGS. 1-3, 8, and 14-16, a progressive press 20 is shown. Progressive press 20 has a base 22 having an upper section 23, a middle section 24 and a lower section 28. Base 22 preferably has a generally triangular footprint. Base 22 is preferably fabricated from aluminum or another appropriate metal but may be fabricated in whole or part of other materials, including plastics. Upper, middle and lower sections 23, 24 and 28 are preferably three separate components that are bolted together to form the base 22.

Upper section 23 has a plurality, preferably three, of vertically oriented upper longitudinal cavities 26. Middle section 24 has a plurality, preferably three, of vertically-oriented lower cavities 30 aligned with the vertically oriented upper longitudinal cavities 26. Each of the lower cavities 30 has an upper circular socket 32 in an upper part of a lower cavity 30 and a lower circular socket 34 in a lower part of the lower cavity 30.

It is to be appreciated that the above description describes one embodiment of the base 22, and it may be fabricated as a single piece, or two pieces, or more, and that the lower cavities 30 can be located in any of the various base sections at the convenience of the designer. In some embodiments, the lower section 28 may be omitted.

Figure 4:
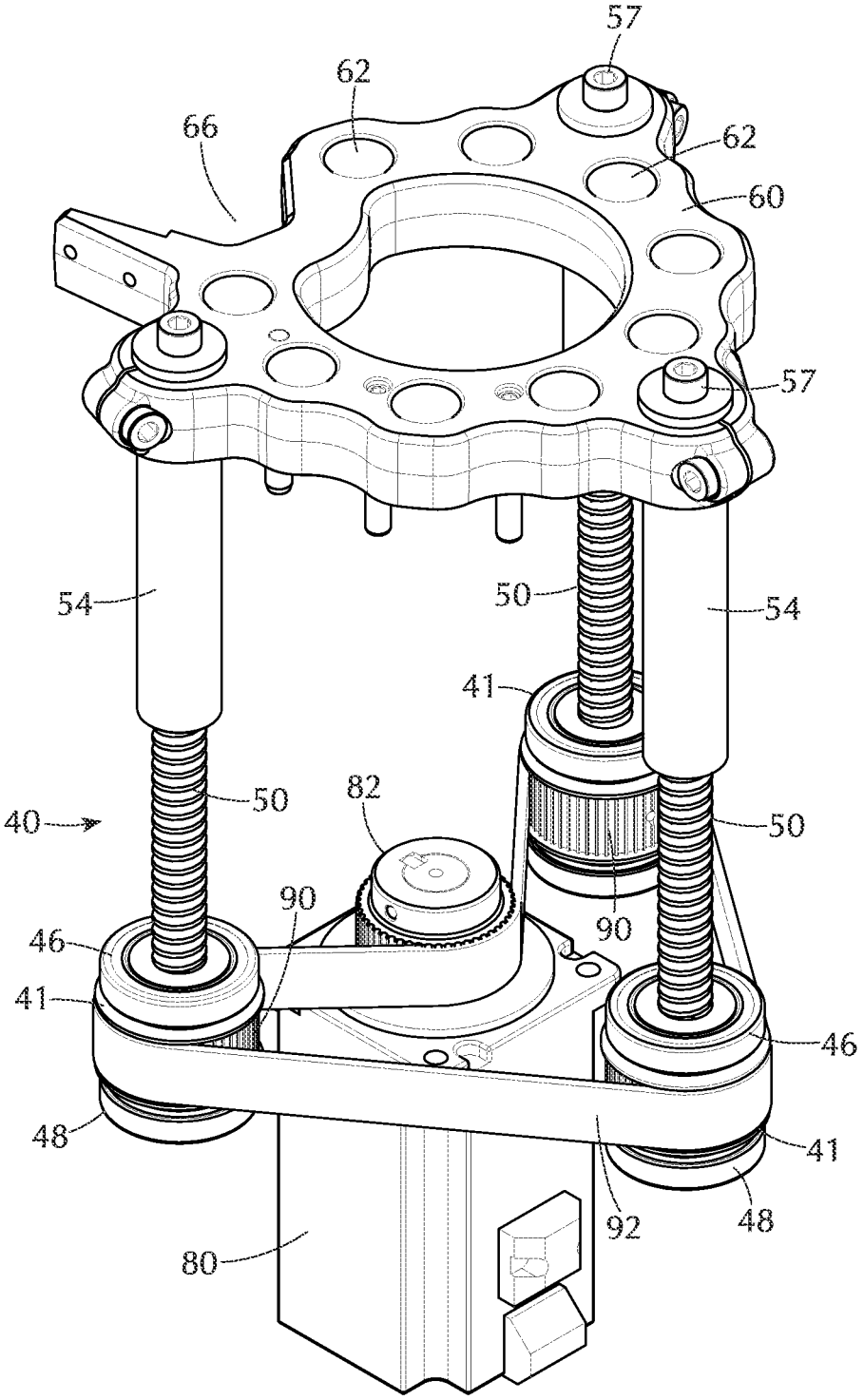
FIG. 4 is a top, left side and rear perspective view of the progressive press of FIG. 1 with the base and shell plate removed to show the press motor, press drive and tool head.
Figure 5:
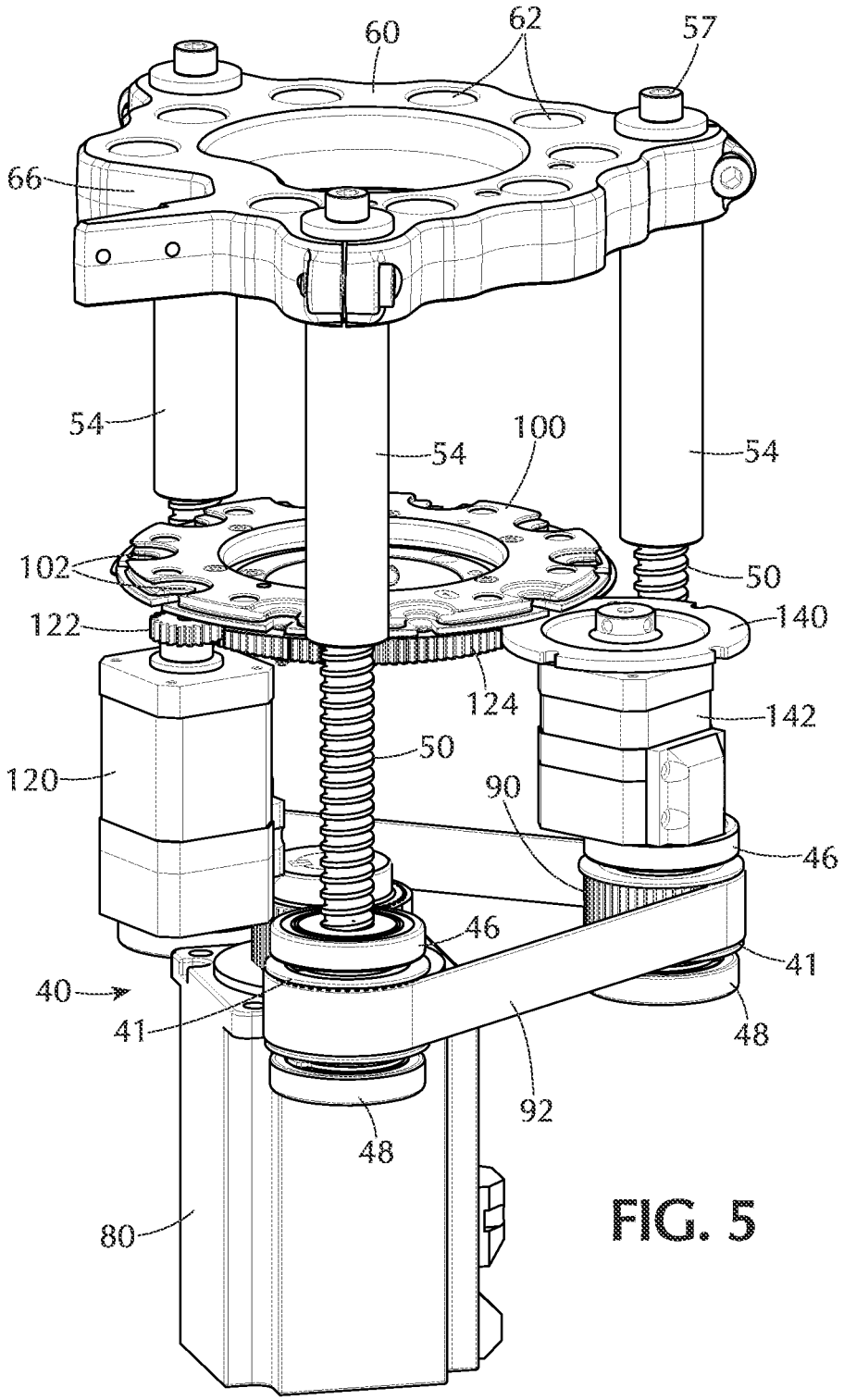
FIG. 5 is a top, front and left side perspective view of the progressive press of FIG. 1 with the base removed to show the press motor, press drive and tool head, the shell plate motor and shell plate, and the primer plate motor and primer plate.

As best seen in FIGS. 4 and 5, a press drive 40 for providing reciprocating movement to a tool head 60 is provided. In one embodiment, press drive 40 comprises a reversible press motor 80 which is operably engaged via a synchronous drive system with a plurality of threaded nuts 41 and matching threaded power screws 50.

Referring to FIGS. 4, 5, 6, 7, and 14, nuts 41 are vertically oriented and are retained in each of the vertically-oriented lower cavities 30. In the preferred embodiment there are three nuts 41 retained in three lower cavities 30. Preferably, the lower cavities 30 in base 22 and the nuts 41 provided therein are equidistant from each other, thereby forming a triangular layout, specifically, and equilateral triangle layout.

The nuts 41 have at least one exterior bearing 44, and preferably there are two exterior bearings 44, fitted to upper and lower ends of the outer circumference of the nuts 41. In the embodiment shown in the FIGS., each nut 41 has an upper bearing 46 seated in the upper circular socket 32 and a lower bearing 48 seated in the lower circular socket 34. Bearings 46 and 48 retain the nuts 41 in the lower cavities 30.

Figure 6:
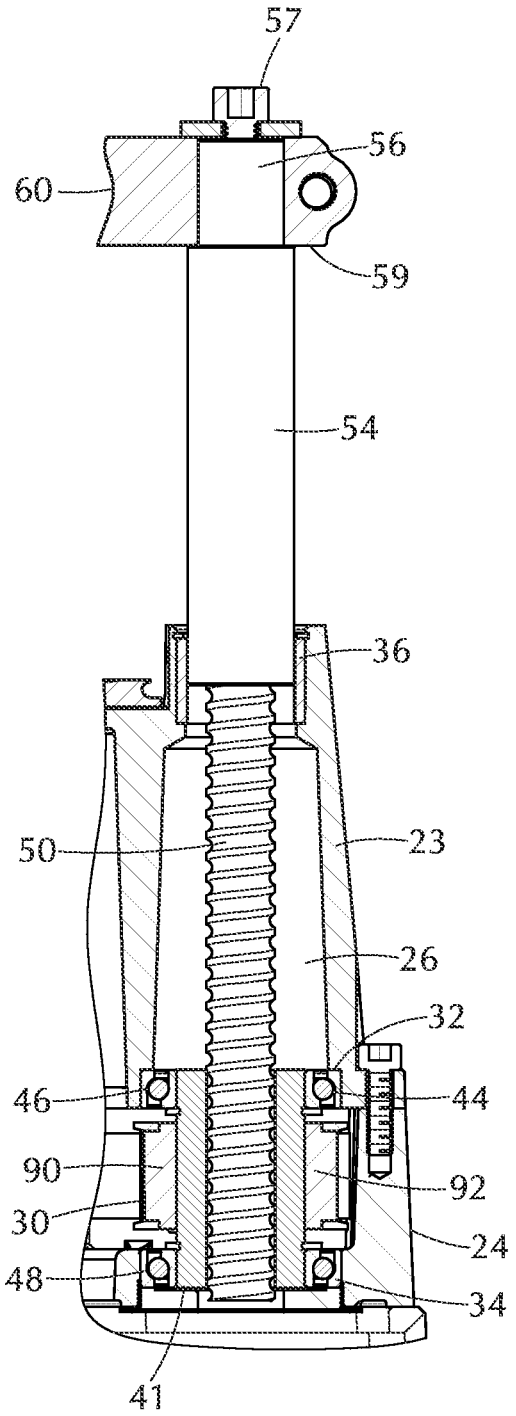
FIG. 6 is a cutaway detail view of a screw and ram positioned in upper and lower cavities of a base showing the screw in an extended position.
Figure 7:
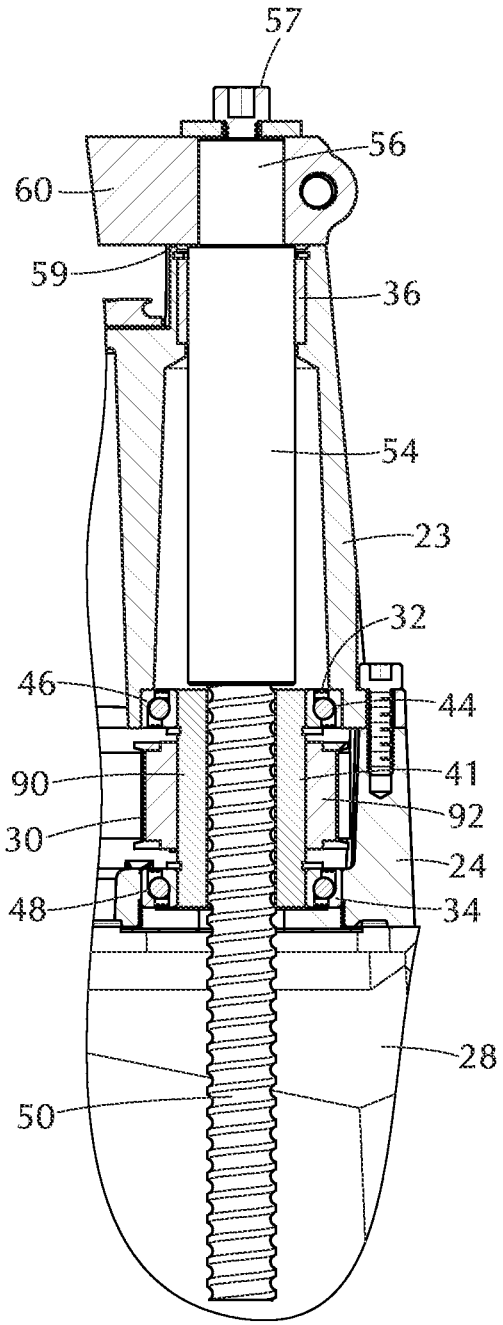
FIG. 7 is a cutaway detail view of a screw and ram positioned in upper and lower cavities of a base showing the screw in a retracted position.

Each vertically-oriented nut 41 has a vertically-oriented power screw 50 having a matching thread threaded into the nut 41. In the preferred embodiment there are three power screws 50 provided in the three nuts 41. Power screws 50 preferably have an unthreaded portion at their upper end which is identified in this application as a ram 54. Preferably, the ram 54 is a cylindrical unthreaded shaft, but other cross-sectional shapes may be used if desired. Each ram 54 has an upper end 56. As seen in FIG. 6-7, the upper end 56 is desirably provided with a shoulder 59 and a tapped hole to receive a bolt and washer 57. Desirably the rams 54 extend upwardly out of base 22 through guide bushings 36 seated in apertures in the top of the upper section 23 of base 22.

The power screws 50 and nuts 41 may be any mating screw and nut arrangement that is suited for use in which the screw is provided with reciprocating motion through the nut by rotation of the nut. Thus, various types of lead screws, for example with a square thread, Acme thread or buttress thread, could be used. However, in one preferred embodiment, the power screws 50 are ball screws 51 and the nuts 41 are ball nuts 42.

The tool head 60 is affixed to the upper ends 56 of rams 54. Tool head 60, as shown in FIGS. 8-11, is generally a rigid annular metal piece having additional extending sections 61 that provide mounts for bolts 57 to attach the tool head 60 to the upper ends 56 of rams 54. Tool head 60 has a plurality of threaded apertures 62 adapted to receive dies 64 and other tools for loading or reloading ammunition. In one preferred embodiment, as seen in FIGS. 8-11, there are ten equidistant positions, which comprise nine threaded apertures 62 and a tenth notch position 66 which serves as a casing loading position. Notch 66 provides room for a feed tube 65 to deliver casings to the progressive press 20, where the casing is mounted to shell plate 100 and clipped in place with a circumferential case retention spring wire (not shown).

Tool head 60 may include a primer decapping die 67, a hold down die 106, a sizing die 68 for re-sizing a casing, a neck expansion/flare die 70, a powder drop station 72 for placing powder in the casing, a powder quantity checking station 74, a bullet drop station 76, a bullet seating die 78, and a bullet crimping die 79.

Vertical reciprocating motion of the rams 54 and the tool head 60 mounted thereon is provided by a reversible press motor 80. Reversible press motor 80 is preferably a servo motor, e.g. a DC or AC motor with a rotary encoder, and desirably also has a position and speed control. Referring again to FIGS. 4, 5, 6, 7 and 14, reversible press motor 80 is mechanically coupled to the vertically-oriented nuts 41 whereby operation of the press motor 80 in one direction causes rotation of the nuts 41 to cause upward travel of the screws 50 to extend the rams 54 and tool head 60 to a selected maximum height; and operation of the press motor 80 in the opposite direction causes reverse rotation of the nuts 41 to cause downward travel of the screws 50 to retract the rams 54 and tool head 60 to a selected minimum height.

In one embodiment of a mechanical coupling between the press motor 80 and the nuts 41, nuts 41 each have a toothed pulley 90 around each nut. Toothed pulley 90 is a ring shaped pulley that slides on a nut 41 and is pinned or keyed in position. The drive shaft of press motor 80 is similarly provided with a toothed pulley 82. A double sided toothed belt 92 connects the motor toothed pulley 82 (which engages with one side of the double sided toothed belt 92) to the nut toothed pulleys 90 (which engage with the other side of the double sided toothed belt 92) as seen in FIGS. 4 and 5.

The arrangement of press motor 80 within base 22 shown in the FIGS. encloses all of the press drive components 40 within the base 22. However, in some embodiments, the lower section 28 may be omitted, and a portion of the press motor 80 extends downwardly below base 22. In this base 22 may be mounted to a work surface having one or more openings through which the press motor 80 and other components extend downwardly.

Referring now to FIGS. 1, 2, 5, 8-10, and 12, a circular shell plate 100 is provided in the top portion of base 22 below the tool head 60. Shell plate 100 has a plurality of recesses 102 around its peripheral edge 104 and a case retention spring wire (not shown) around that peripheral edge 104. Recesses 102 are preferably a keyhole slot with a wider opening and a slot sized for the casing to be loaded/reloaded. In general, optimal results are obtained when the shell plate 100 is specifically sized to a particular caliber of ammunition casing that is being processed. In the embodiment of the invention illustrated in the drawings, the shell plate 100 has ten recesses 102 to match the ten positions in the tool head 60. Shell plate 100 receives empty ammunition casings 200 into the recesses 102 where they are held by the case retention spring wire. The shell plate rotates and the casings 200 are moved through the various stations where loading/reloading operations provided by the vertically reciprocating tool head 60 and associated dies 64 and other equipment is performed. The rotation of the shell plate 100 is indexed to the vertical movement of the screws 50 and rams 54 and tool head 60. In typical embodiments of the invention, the shell plate 100 is stationary when the rams 54 and tool head 60 are retracted and the tool head dies 64 are engaged with the casings 200 seated on the shell plate 100. The positions of recesses 102 of the stationary shell plate 100 are aligned with the positions of the apertures 62 in tool head 60, whereby the dies 64 can operate on the casings 200 seated on the shell plate 100. In typical embodiments of the invention, the shell plate 100 is rotated by one increment when the tool head 60 is lifted. The rotation of the shell plate 100 by one increment advances the position of each recess 102 in the shell plate 100 to the next station where the recess 102 is aligned with the next aperture 62 in the tool head 60 and any die 64 or other tools for loading or reloading ammunition located there.

Figure 8:
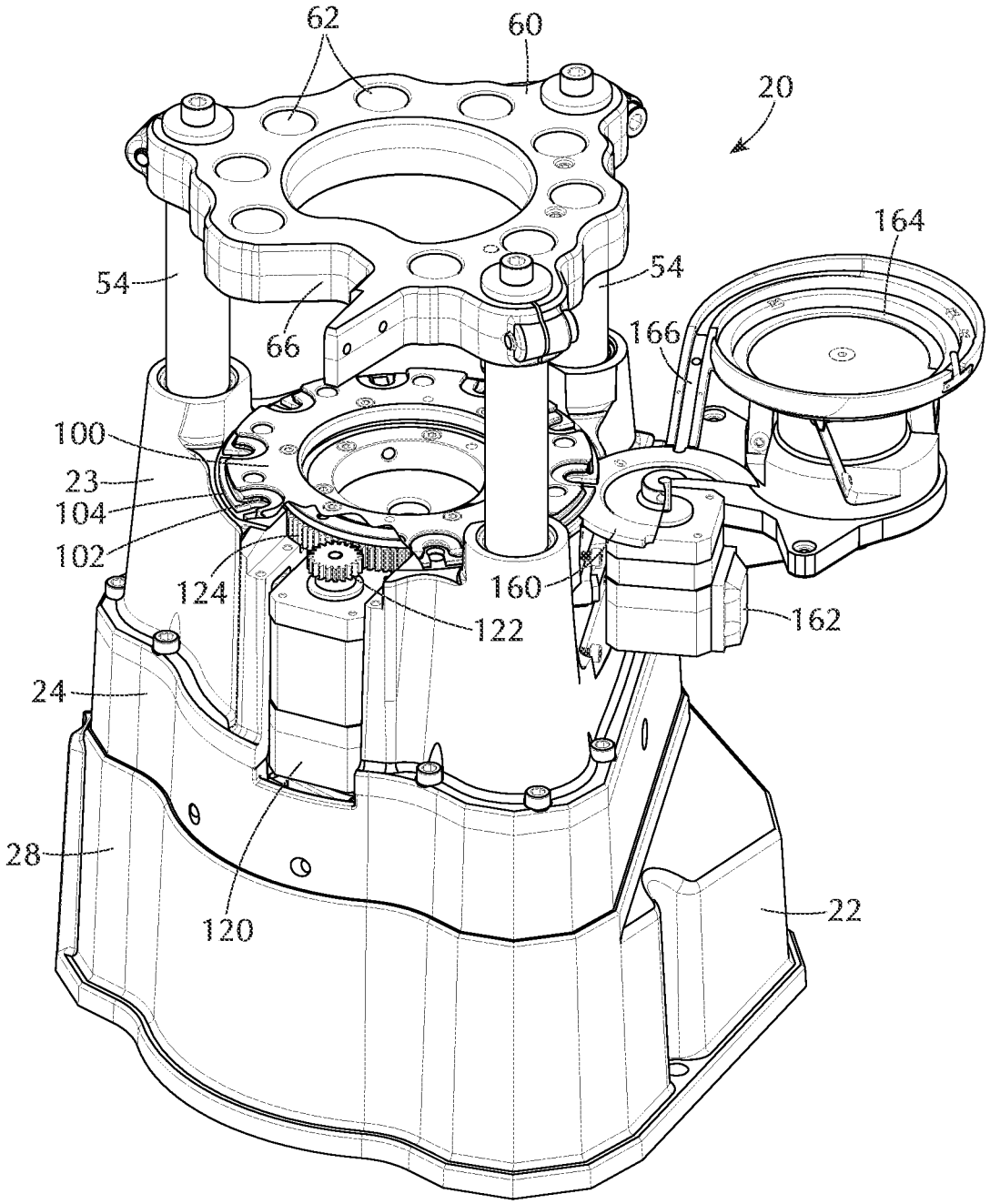
FIG. 8 is a top, front and left side perspective view of the progressive press of FIG. 1 with the shell plate and other elements cutaway to show the shell plate motor and gearing driving the rotation of the shell plate and the primer motor driving the primer plate.
Figure 9:
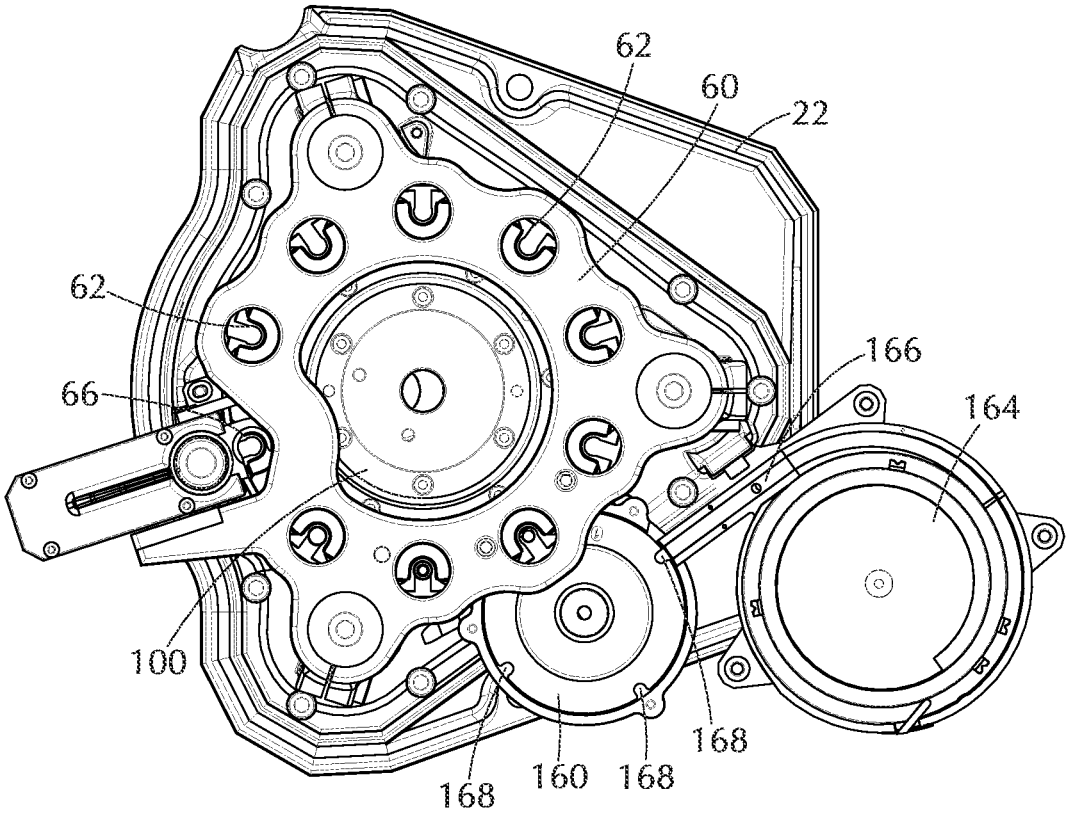
FIG. 9 is a top plan view of the progressive press of FIG. 1.
Figure 10:
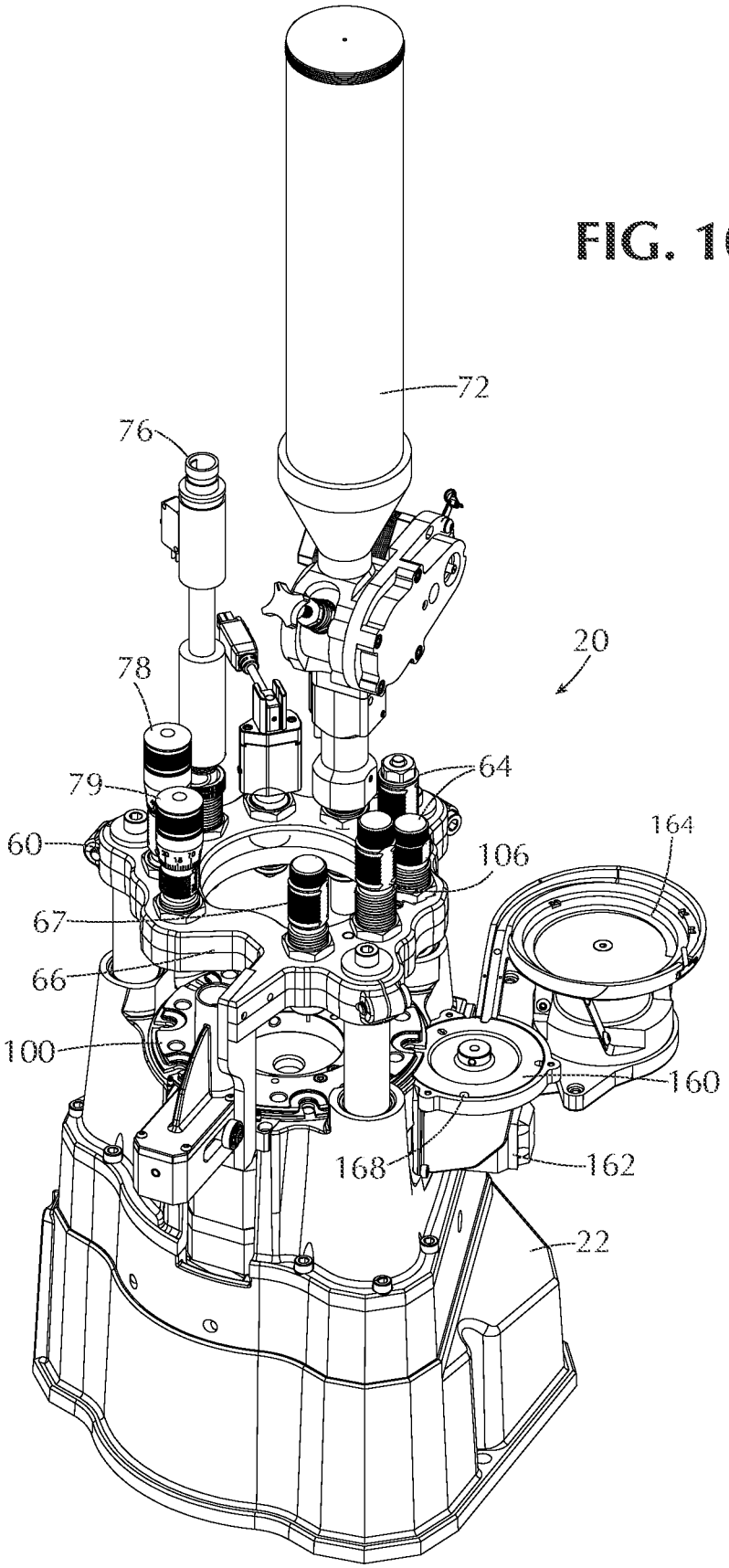
FIG. 10 is a top, front and left side perspective view of the progressive press of FIG. 1 with dies or loading accessories provided on the tool head.
Figure 11:
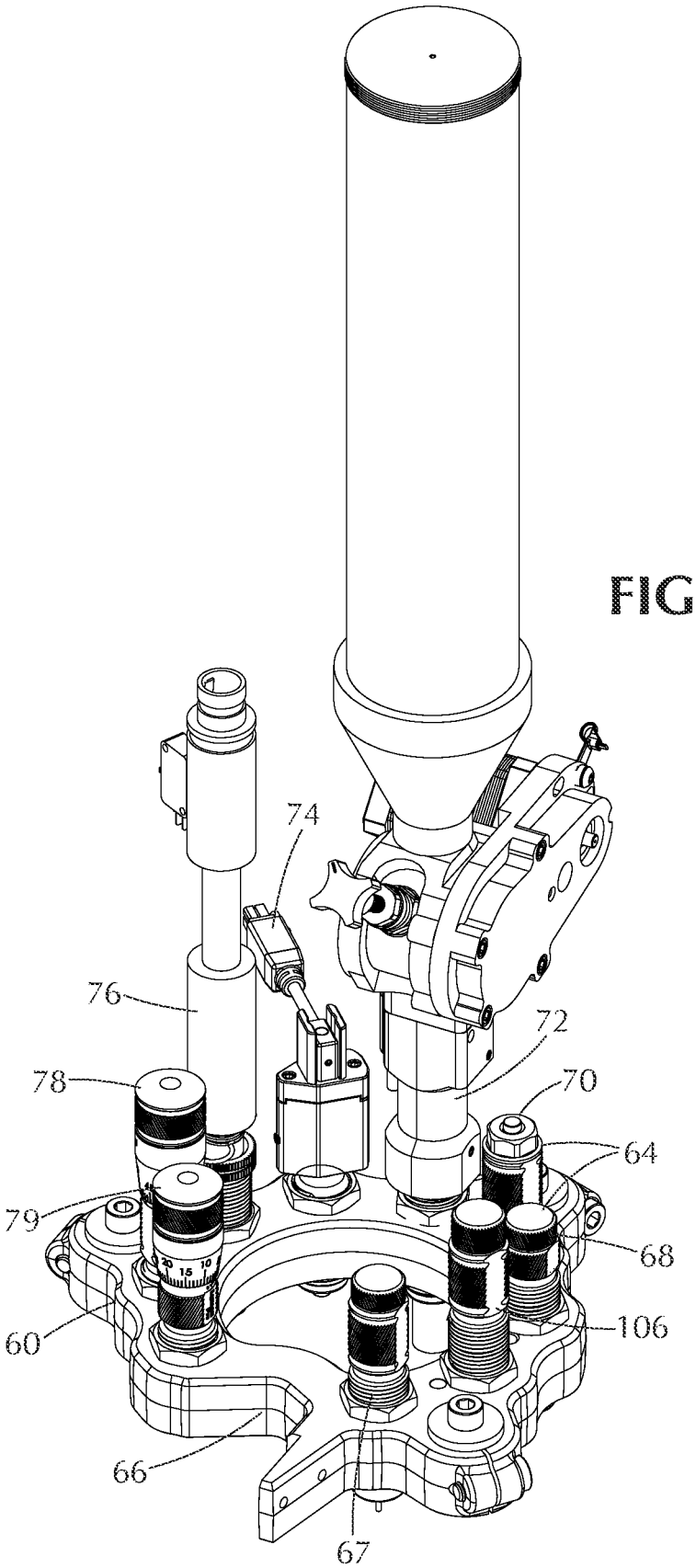
FIG. 11 is a top, front and left side perspective view of the tool head of FIG. 9 with dies or loading accessories provided on the tool head.

Shell plate 100 may be driven by the press motor 80 via a mechanical linkage such as a gear mechanism or a cam and ratchet mechanism that is engaged with and driven by engagement with rams 54. In the preferred embodiment of the invention, which is best seen in FIGS. 5 and 8, movement of shell plate 100 is provided by a separate shell plate motor 120. Shell plate motor 120 has a shell plate motor gear 122 mounted the drive shaft of the motor 120. Motor gear 122 engages a ring gear 124 to which the shell plate 100 is mounted, thus providing rotation of the shell plate 100. Shell plate motor 120 can be an AC or DC motor but is preferably a DC servomotor, to allow finer control of indexing between the movement of the shell plate 100 and the tool head 60.

The loading of an empty casing 200 in shell plate 100 and an exemplary series of processing steps arising from the increments of rotational movement of the shell plate to sequentially advance the empty casing through a series of processing operations in one embodiment of the invention is described below.

An empty casing 200 is received at the shell plate 100 at the casing loading position located at tool head 60 notch position 66 via feed tube 65. The casing 200 is mounted to a recess 102 in shell plate 100 and clipped in place with the case retention spring wire.

The tool head 60 is extended and the shell plate 100 rotates by one increment of 36° to a primer decapping position. At the primer decapping position, the tool head is retracted downwardly and a primer decapping die 67 (typically having a downwardly extending vertical rod) descends with the tool head and punches any spent primer that may be in the casing out of the casing.

Figure 12:
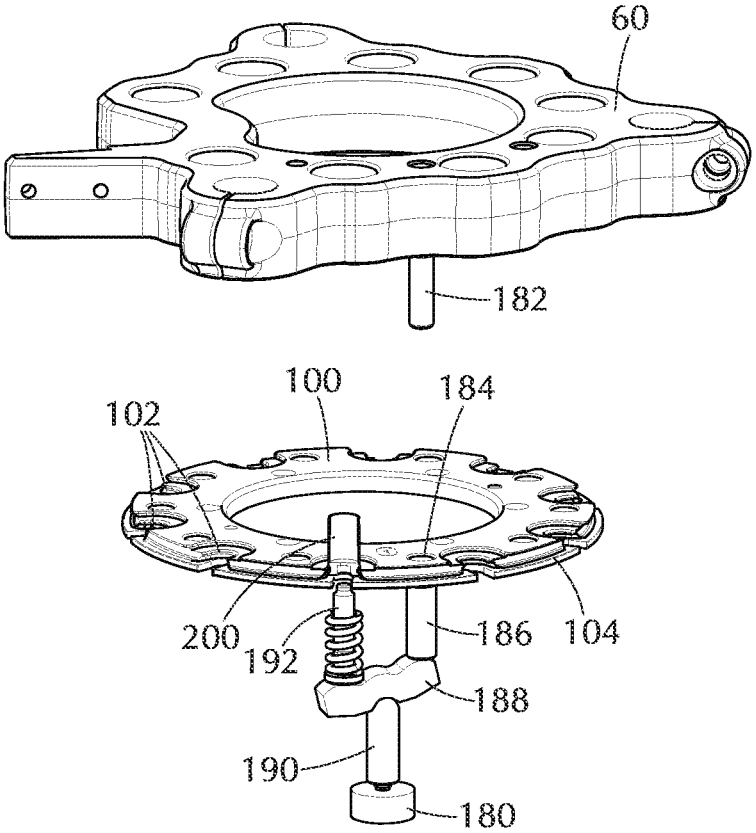
FIG. 12 is a top, front and left side perspective view of the tool head and shell plate of FIG. 1 with the tool head positioned in its extended position above the shell plate, and a cross-section of an empty casing located above the swaging rod.
Figure 13:
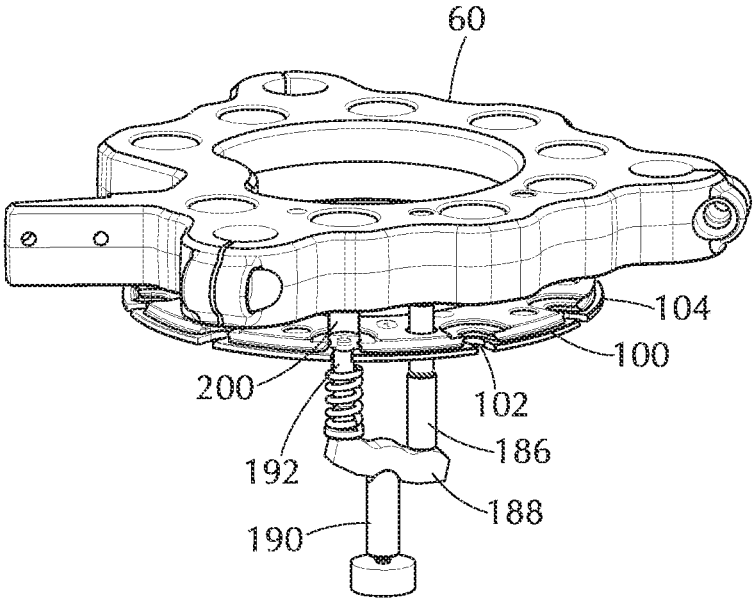
FIG. 13 is the top, front and left side perspective view of the tool head and shell plate of FIG. 12 with the tool head positioned in its retracted position above the shell plate, showing a swaging rod forming a primer pocket in the empty casing.
Figure 14:
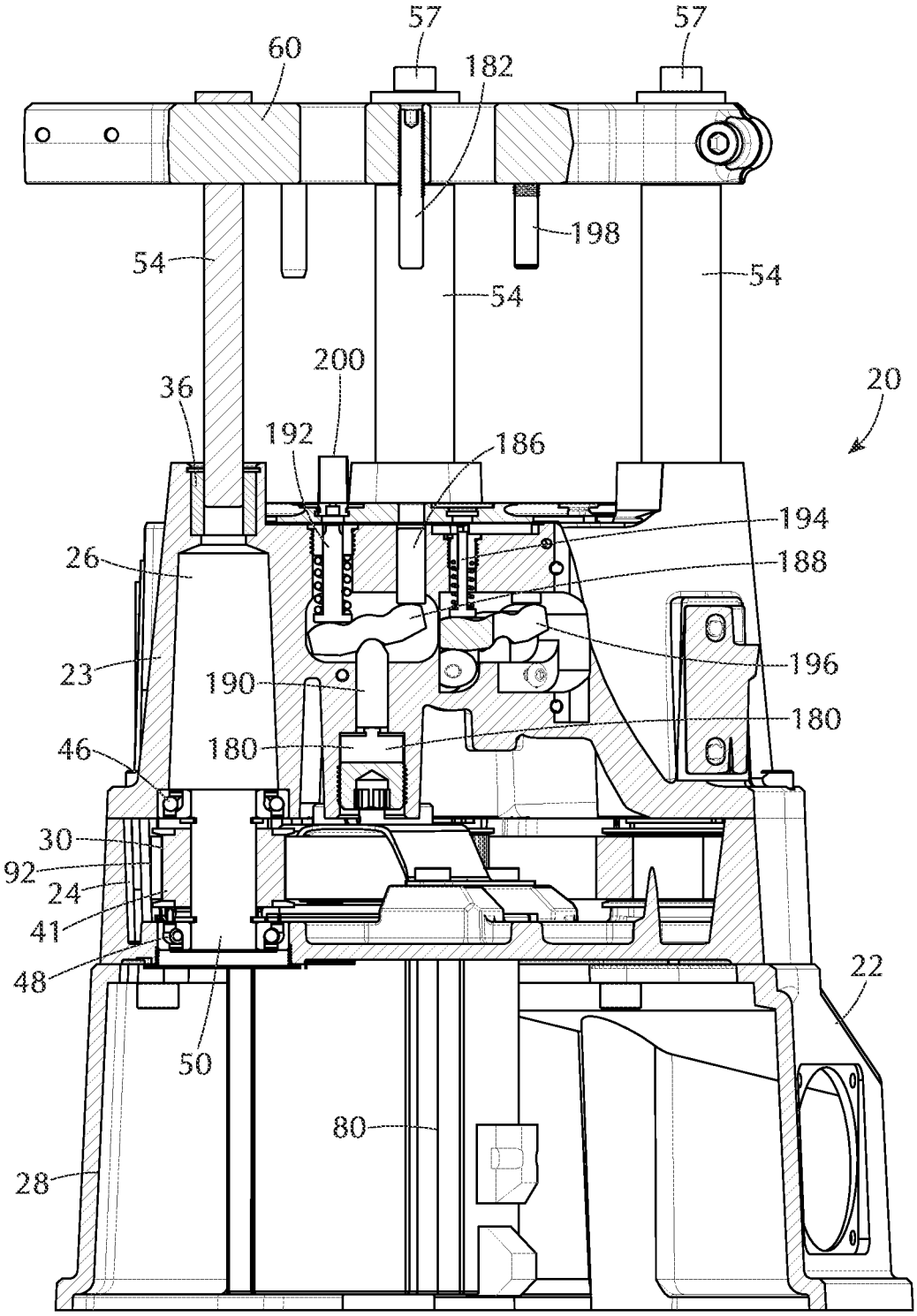
FIG. 14 is a left side cross-sectional elevation view of the progressive press of FIG. 1.

The tool head 60 is extended again and the shell plate 100 rotates by another increment of 36° to a primer pocket swage position, which is best seen in FIGS. 12, 13, and 14. At the primer pocket swage position, the tool head is retracted downwardly and a swage actuation pin 182 extending downwardly from tool head 60 passes through a hole 184 on shell plate 100 and pushes down on swage connecting pin 186. Swage connecting pin 186 presses down on rocker 188. Rocker 188 is centered on fulcrum pin 190 and transfers the downward force on swage connecting pin 186 to an upward force on primer pocket swage rod 192. At this point in the cycle the casing 200 located above the primer pocket swage rod 192 is held in position on the shell plate 100 by hold down die 106. Hold down die 106 includes a rod which enters casing 200 from above and holds it down while the primer pocket swage operation is completed. Primer pocket swage rod 192 is extended upwardly by rocker 188 and reforms the primer pocket in casing 200 so that it is correctly sized to receive and retain a new primer.

In a preferred embodiment of the invention, fulcrum pin 190 is seated on a load cell 180, as seen in FIGS. 12, 13 and 14. Load cell 180 is a strain gauge with a Wheatstone bridge circuit which measures the swage force encountered by the swage rod during the primer pocket swaging step. The measured swage force serves as a quality control determination. For example, if there is no swage force measured, that may indicate that the primer pocket area of the casing is missing the required metal needed to form a pocket. If the measured swage force is excessive, this may indicate that there is an obstruction or corrosion in the primer pocket that will prevent the primer from properly seating in the primer pocket. If the measured swage force is out of specification, the control system 140 may automatically stop the press 20 and/or issue an alarm or alert to the operator. There is a potential risk of igniting a primer during the subsequent installation of the primer in the primer pocket if the primer is not seated properly, and thus the swage force sensing provided by load cell 180 can prevent personal injury or damage to the press 20 by the inadvertent ignition of a primer.

After pocket swaging, the tool head 60 is extended again and the shell plate 100 rotates by another increment of 36° to a casing sizing and primer loading position, where sizing die 68 resizes the casing, while a primer is simultaneously received from a notch 168 in primer plate 160 and seated in the primer pocket by a primer punch 194. Primer punch 194 is actuated by rocker 196 when primer punch actuation pin 198 extending downwardly from tool head 60 passes through a hole in shell plate 100 and pushes down on a primer punch connecting pin (not shown) which presses on one side of the rocker 196, causing the other side of rocker 196 to move upwardly and the primer punch 194 to move upwardly and seat the primer in the primer pocket. The primer pocket swage rod 192 and primer punch 194 operates very similarly to each other.

After this step, the tool head 60 is extended again and the shell plate 100 rotates by another increment of 36° to a neck expansion/flare die 70 which adjusts the opening at the upper end of the casing to an appropriate size to receive the bullet when the tool head 60 is retracted downwardly to the working position.

Next, the tool head 60 is extended again and the shell plate 100 rotates by another increment of 36° to a powder drop station 72 where a measured amount of smokeless powder is dropped into the casing 200.

The tool head 60 is extended again and the shell plate 100 rotates by another increment of 36° to a powder quantity checking station 74 where the amount of powder is checked with an optical probe or contact probe to confirm that the level of powder loaded in the casing is within specifications.

The tool head 60 is extended again and the shell plate 100 rotates by another increment of 36° to a bullet drop station 76 where a bullet is placed in the open upper end of casing 200.

The tool head 60 is extended again and the shell plate 100 rotates by another increment of 36° to a bullet seating station 78 where the dropped bullet is positioned with a die so it is seated in the open upper end of casing 200.

The tool head 60 is extended again and the shell plate 100 rotates by another increment of 36° to a bullet crimping station where a bullet crimping die 79 crimps the bullet in casing 200.

The tool head 60 is extended again and the shell plate 100 rotates by another increment of 36° to its initial casing loading position. In this final rotational increment, the completed ammunition cartridge is extracted between the bullet crimping station and the casing loading position by a flange positioned in the path of the casing travel which extracts the cartridge from the recess 102 in shell plate 100.

Primers are preferably delivered to a position below a recess 102 by a primer plate 160, where they are seated in the primer pocket of a casing by a primer punch. Most primers employ a Boxer type construction, which is consists of two components—a cup and an anvil. The cup is on one end of the primer having rounded edges. The anvil is on the opposite end of the primer and has sharp 90 degrees corners. An explosive mixture is located between the cup and the anvil. The Boxer type primers are inserted into a cartridge anvil side first. Primers used in press 20 are oriented in the correct direction in a vibrating primer bowl 164. The oriented primers are delivered via feed ramp 166 to primer plate 160. Primer plate 160 has a plurality of notches 168 (preferably four) around its perimeter which each receive one primer delivered via ramp 166. Ramp 166 may be provided with optical or other sensors to detect the presence of primers in the ramp 166. A negative detection signal from the primer sensor will indicate an insufficient primer count in the ramp 166 and can be used to signal control system 140 to interrupt operation of the press 20 or to trigger an audible alarm to notify an operator to manually terminate operation of the press 20. Ramp 166 may also be provided with an inductive proximity sensor which serves as a primer position sensor to sense whether primers in ramp 166 are positioned in the correct top side-up orientation, and in the case of negative sensor result can also be used to signal control system 140 to interrupt operation of the press 20 or to trigger an audible alarm to notify an operator to manually terminate operation of the press 20.

Primer plate 160 is rotated by primer motor 162. Primer plate 160 may be directly mounted to primer motor 162 as shown in the drawings, or it may be coupled by a gear or belt system. Primer motor 162 is preferably a DC servo motor. The operation of primer motor 162 is indexed to the movement of the shell plate 100 whereby a primer is delivered to a position below a recess 102 in shell plate 100 at a time prior to the upward movement of primer punch 194 which seats the primer in the primer pocket of casing 200.

Control system 140 controls operation of the reversible press motor 80. Control system 140 preferably includes sensors, software controls, and a user interface in accordance with U.S. Pat. Nos. 9,151,583; 10,281,253; and 10,753,717; the disclosures of which are hereby incorporated by reference.

Control system 140 is an electronic control system which communicates with all of the components of press 20. The control system 140 provides servo control signals to the servo motors, e.g. press motor 80, shell plate motor 120, and primer motor 142. The control system receives back step pulses generated by the servo motor encoders which reflect movement of the servo motors. In this way, the control system 140 can continuously monitor the position of all components of press 20 in real time. Control system 140 has a clock which provides a synchronization pulse to synchronize the operation of all the components of press 20. The synchronization pulse serves to coordinate the extension and retraction of the tool head 60 with the rotation of the shell plate 100 and the delivery of a primer by the primer plate 160 so that the movements of the various components are coordinated no matter the speed at which the press 20 is operated.

Control of the speed of press 20 is implemented via the control system 140, which controls the speed and quantity of revolutions of each motor in press 20, including the press motor 80, the shell plate motor 120, and the primer motor 162. Thus for example the speed and quantity of revolutions of press motor 80 can be specified for each extension stroke and the length of the stroke can be controlled by specifying the number of revolutions of press motor 80 (for example, 5 revolutions, or 10 revolutions). A user interface can simplify the user input by specifying a height of tool head travel, and the control system 140 can convert this input to a requisite number of press motor 80 rotations needed to drive the screws 50 the necessary distance to obtain the specified height. The retraction stroke (reverse direction) revolutions will generally be always set to match the extension stroke revolutions so that the length of the retraction stroke is the same length as the extension stroke. The control system 140 also controls the speed of rotation of each motor, thereby controlling both the overall speed of the press 20, but also the speed of movement of tool head 60 during different parts of each stroke cycle. For example, the beginning of each extension stroke can start slowly, accelerate during the extension stroke, then decelerate at the top of the extension stroke; the retraction stroke again can start slowly, accelerate during the retraction stroke; and decelerate at the end of the retraction stroke. In this way, it is possible to control and extend the dwell time during which the tool head 60 is stationary during the top and bottom of the stroke. This may be advantageous to allow for example, a longer stationary period for powder or a bullet to be dropped into a casing.

Press motor 80 may have a torque sensor that communicates with control system 140. Control system 140 may be used to provide an alarm when the torque sensor determines that the press motor 80 torque exceeds a selected limit. For example, a torque limit alarm might be set at 20% of the maximum motor torque and if an alarm is triggered the press 20 can be automatically stopped. In some embodiments, the torque sensor may be programmed to provide an alarm at a low torque value during the extension stroke, but at a much higher value during the retraction stroke. Such torque alarms may be useful to prevent damage to misaligned casings.

Figure 17:
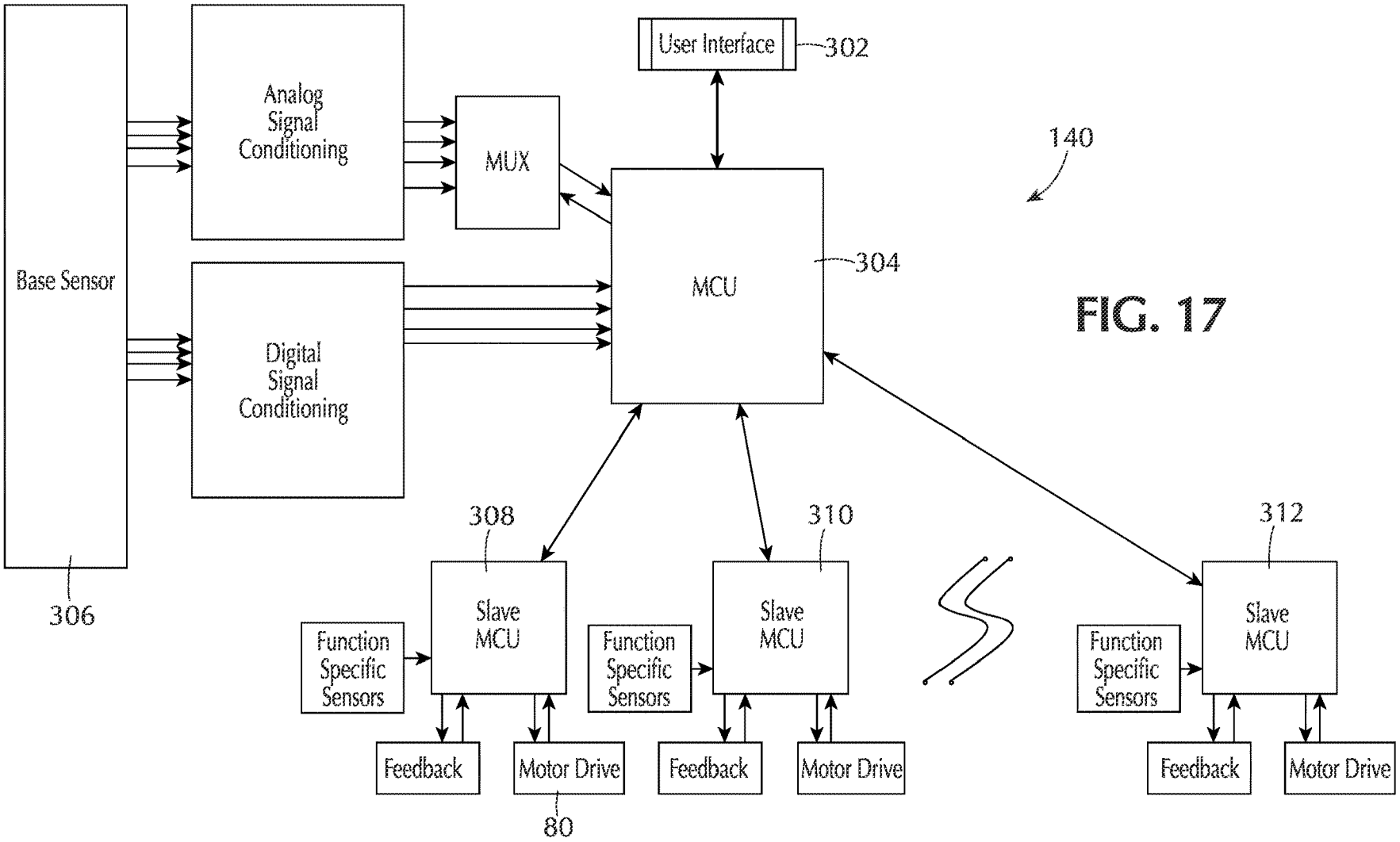
FIG. 17 is a schematic diagram of the operation of the control system 140.

In one embodiment, shown schematically in FIG. 17, a user interface 302 communicates with a microprocessor control unit 304 which receives sensor data from a plurality of sensors 306 in press 20 and sends control instructions to microprocessor controls 308, 310 and 312 for press motor 80, shell plate motor 120, and primer motor 142.

Figure 15:
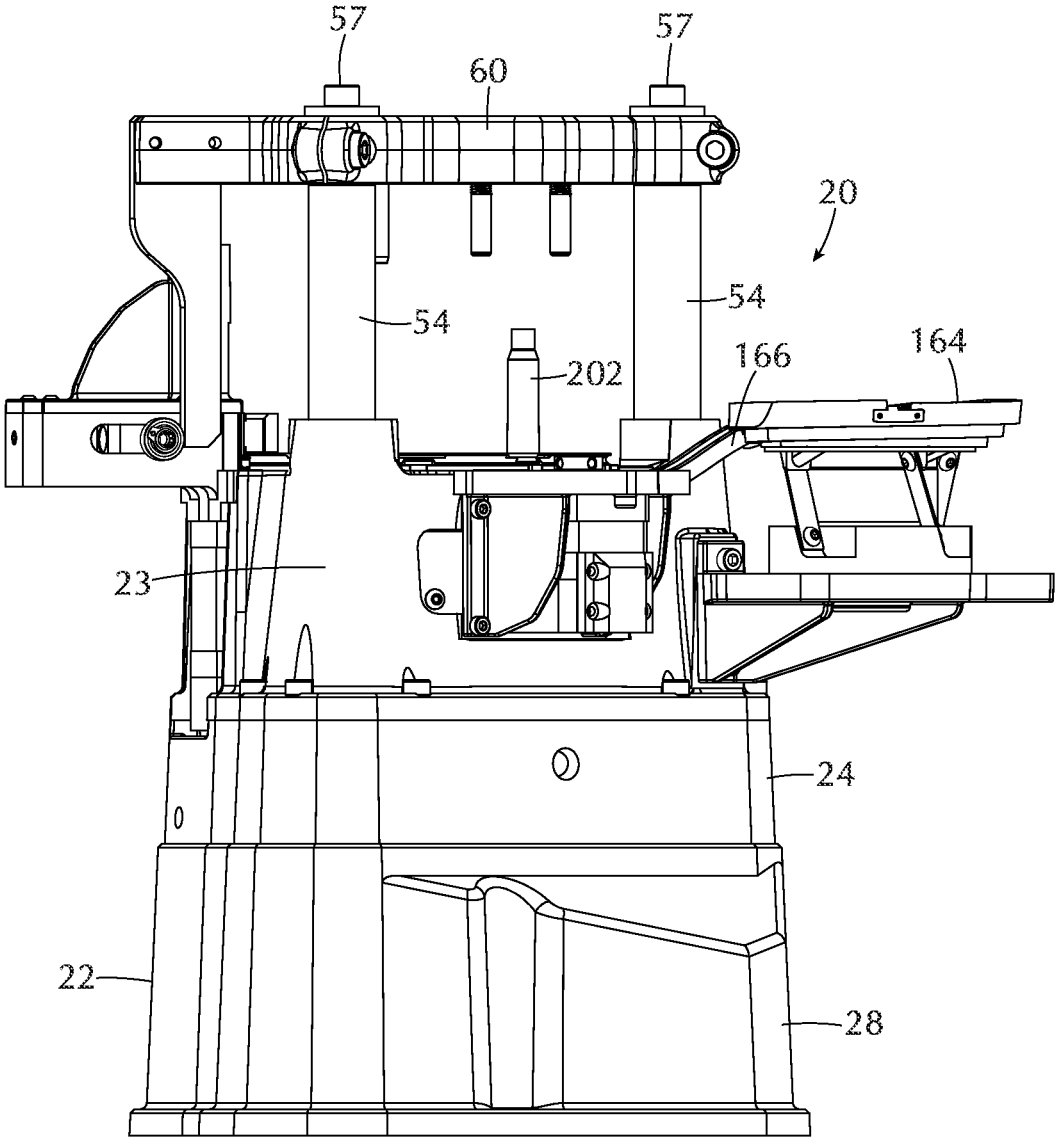
FIG. 15 is a left side elevation view of the progressive press of FIG. 1 showing with the tool head positioned in its extended position above the shell plate for use in loading/reloading a rifle ammunition casing.
Figure 16:
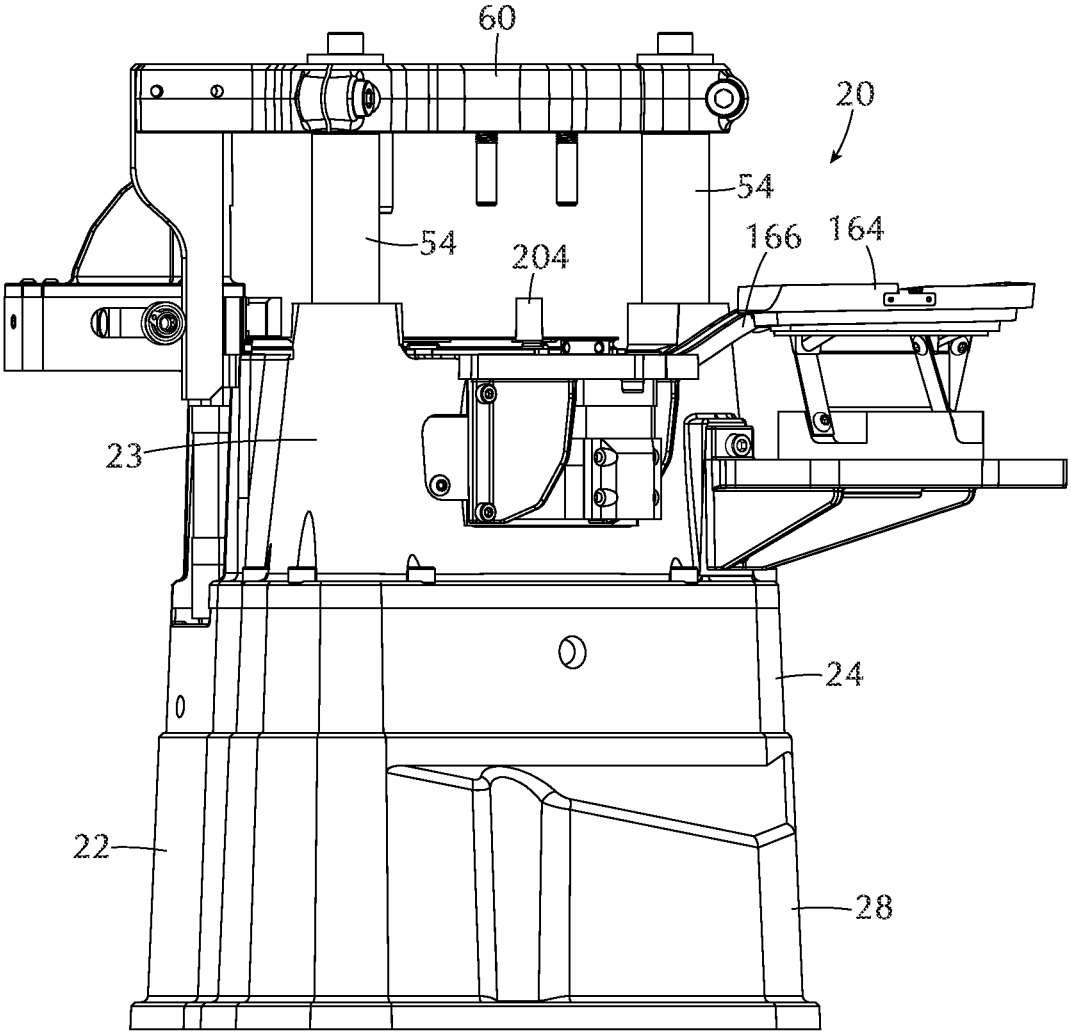
FIG. 16 is a left side elevation view of the progressive press of FIG. 1 showing with the tool head positioned in its extended position above the shell plate for use in loading/reloading a pistol ammunition casing.

The control of press motor 80 by control system 140 allows a user to specifically control the stroke length of the rams 54. This allows the user to select and set a maximum height and a minimum height of the rams 54 and tool head 60 during operation. The user can accordingly specify a maximum height appropriate for the particular ammunition size that is being loaded/reloaded. For example, pistol ammunition is typically shorter that rifle ammunition, so the user could set the maximum height at 2.0 inches for many sizes of pistol ammunition, but might set the maximum height at 3.5 inches for many sizes of rifle ammunition. This difference is illustrated by comparison of FIGS. 15 and 16. FIG. 15 shows the tool head 60 positioned above the shell plate at a height useful in loading/reloading a rifle ammunition casing 202; FIG. 16 shows the tool head positioned above the shell plate at a height useful in loading/reloading a pistol ammunition casing 204. As can be seen there can be a meaningful difference in travel depending on the size of the ammunition casing.

The control of maximum height by providing an adjustable or variable stroke length in the tool head 60 lift mechanism provides greater opportunities for efficiency, as the movement of the tool head 60 can be tailored to the ammunition requirements, thus eliminating wasted movement and the time required for the wasted movement. During testing of a prototype of the invention, it was determined that a production rate of 2500 rifle cartridges/hour is possible in the embodiment shown in the drawings, but by adjusting the maximum height to a lower height for pistol cartridges, a production rate of 3500 pistol cartridges/hour is possible.

Driving shell plate 100 using a dedicated shell plate motor 120 also provides substantial advantages over a linkage to the main drive unit of the press. Specifically, driving shell plate 100 using a dedicated shell plate motor 120 allows the user to define the indexing relationship between the movement of the tool head 60 and movement of the shell plate 100. Using the control system 140, the user can select the point in the reciprocating travel of the tool head 60 at which movement of the shell plate 100 is initiated. For example, the user can specify that the rotation of the shell plate 100 will be initiated earlier in the cycle of the tool head 60 upward travel when shorter pistol ammunition cartridges are being loaded/reloaded, but later in the cycle of the tool head 60 upward travel when taller rifle ammunition cartridges are being loaded/reloaded, so that there is time for the tool head and dies to get clear of the casings 200 before the shell plate 100 is rotated.

In one exemplary embodiment, the control system could allow input of a casing height and the height of any dies, optionally with an appropriate margin of error, as the amount of travel of the tool head 60 required before the shell plate 100 rotation can be initiated via shell plate motor 120. Upon initiation of rotation, the shell plate 100 will move each casing to its next station and rotation is terminated. This fine control of indexing between the movement of the shell plate 100 and the tool head 60 provides flexibility and increased throughput by allowing the user to specify the point in the tool head 60 travel when rotation of the shell plate 100 is initiated.

Another advantage of driving shell plate 100 using a dedicated shell plate motor 120 is that the speed of shell plate 100 can be controlled very precisely. During the relocating segment of the processing cycle, when the shell plate is rotated to advance a casing from one position to the next, the speed of the movement of the shell plate can begin slowly, and then increase, and then decrease as the casing approaches its next position. This management of the acceleration forces on the casing helps to reduce abrupt lateral forces on the casing that might alter or disturb the vertical alignment of the casing by movement of the casing caused by the shell plate 100 rotation. Different size ammunition casings are susceptible to disturbance to different degrees. For example, taller rifle ammunition casings 202 are more likely to be displaced than shorter pistol ammunition casings 204. Therefore, the control system 140 can allow an input to specify the casing size as a rifle casing or a pistol casing, and the control system 140 will be able to control the shell plate motor 120 to provide a gradual acceleration of rotational motion of the shell plate and a gradual deceleration of rotational motion of the shell plate as the shell plate 100 periodically advances a casing from one position to the next. The control system 140 can also limit the rotation speed of the shell plate 100, along with the stroke speed of the press motor 80, to a maximum speed which is optimized for the input casing size.

The control of the indexing between the movement of the tool head 60 and movement of the shell plate 100 increases the flexibility of the system for use with different sizes of ammunition casings as suggested above, or different powder loads, or other variables.

While the present technology has been described with reference to particular embodiments and arrangements of parts, features, and the like, the present technology is not limited to these embodiments or arrangements. Indeed, many modifications and variations will be ascertainable to those of skill in the art, all of which are inferentially included in these teachings

What is claimed is:

1. A progressive press, comprising:

a base having a plurality of cavities;

a plurality of nuts retained in the base, the nuts being aligned with the cavities;

a plurality of screws provided in the plurality of nuts and extending through the cavities, the screws each having a ram at their upper ends;

a tool head affixed to the rams at the upper ends of the screws, the tool head having plurality of apertures adapted to receive dies and other tools for loading or reloading ammunition;

a rotatable shell plate having a plurality of recesses around a peripheral edge thereof adapted to receive ammunition casings;

a reversible press motor, mechanically connected to the nuts to cause rotation thereof;

wherein operation of the press motor in one direction causes rotation of the nuts to cause upward travel of the screws to extend the tool head, and operation of the press motor in another direction causes reverse rotation of the nuts to cause downward travel of the screws to retract the screws and tool head.

2. The progressive press of claim 1, the shell plate being rotated in indexed movement whereby rotation of the shell plate is indexed to extending and retracting of the screws;

whereby the shell plate is stationary when the screws are retracted, with a position of at least one recess in the shell plate aligned with a position of at least one aperture in the tool head; and whereby the shell plate is rotated during one or more of extension and retraction of the screws, to move the position of the least one recess in the shell plate to a position aligned with another aperture in the tool head.

3. The progressive press of claim 2, further comprising:

a rotatable primer plate having a plurality of notches around a perimeter thereof; and a primer motor to rotate the primer plate;

rotations of the primer plate being indexed to movement of the shell plate whereby a primer plate notch is periodically aligned with a shell plate recess.

4. The progressive press of claim 1, where downward travel of the screws retracts the screws and tool head to position the tool head adjacent the shell plate.

5. The progressive press of claim 1, wherein the plurality of apertures in the tool head have mounted therein one or more dies selected from the group consisting of a primer decapping die, a swage rod for forming a primer pocket, a primer punch for seating a primer in the primer pocket, a sizing die for re-sizing a casing, a neck expansion/flare die, a bullet seating die, and a bullet crimping die.

6. The progressive press of claim 1, wherein the press motor has a speed control, and further comprising a control system, the control system controlling operation of the press motor including speed of the press motor revolutions and quantity of press motor revolutions.

7. The progressive press of claim 6, wherein the press motor is a servo motor; whereby a selected maximum height and selected minimum height of the screws and tool head are set by a user using the control system.

8. The progressive press of claim 6, wherein the press motor has a torque sensor that communicates with the control system and the control system provides an alarm when the torque sensor determines that the press motor torque exceeds a selected limit.

9. The progressive press of claim 1, wherein each nut is a ball nut, and each screw is a ball screw, and each ball nut has one or more external bearings rotably retaining the ball nut in a longitudinal cavity in the base.

10. The progressive press of claim 1, wherein the nuts each have a toothed pulley provided with each nut, and the press motor is provided with a toothed pulley, and a toothed belt connects the press motor toothed pulley to the nut toothed pulleys.

11. The progressive press of claim 1, wherein the plurality of screws comprise three ball screws and the plurality of nuts comprise three ball nuts.

12. The progressive press of claim 1, wherein the shell plate is driven by a shell plate motor.

13. The progressive press of claim 12, wherein the shell plate includes a ring gear and the shell plate motor has a gear mounted thereto, the shell plate motor gear driving the shell plate ring gear.

14. A progressive press, comprising:

a base having three vertically oriented upper cavities spaced apart in a triangle arrangement and lower cavities aligned with the vertically oriented upper cavities;

a vertically-oriented ball nut retained in each one of the lower cavities, each ball nut having an exterior bearing whereby each ball nut is retained in and rotatable in one of the lower cavities;

a vertically-oriented ball screw provided in each one of the ball nuts, the ball screws having a ram at their upper ends;

a rigid tool head, having a plurality of apertures adapted to receive dies and other tools for loading or reloading ammunition, affixed to upper ends of the three rams;

a reversible press motor with speed control, mechanically connected to the ball nuts to cause rotation thereof, wherein operation of the press motor in one direction causes upward travel of the ball screws to extend the rams and tool head, and operation of the press motor in another direction causes downward travel of the ball screws to retract the rams and tool head; and a rotatable shell plate having a plurality of recesses around a peripheral edge thereof adapted to receive ammunition casings, the shell plate being rotated by a shell plate motor in indexed movement whereby rotation of the shell plate is indexed to extending and retracting of the screws;

whereby the shell plate is stationary when the screws are retracted, with a position of at least one recess in the shell plate aligned with a position of at least one aperture in the tool head; and whereby the shell plate is rotated during one or more of extension and retraction of the screws, to move the position of the least one recess in the shell plate to a position aligned with another aperture in the tool head.

15. The progressive press of claim 14, wherein each ball nut has an upper bearing seated in an upper circular socket in an upper part of a lower cavity and a lower bearing seated in a lower circular socket in a lower part of the lower cavity.

16. The progressive press of claim 15, wherein each ball nut has a toothed pulley affixed thereto, and the press motor has a toothed pulley affixed thereto, and a toothed belt is mounted to and connects the press motor toothed pulley to the ball nut toothed pulleys.

17. The progressive press of claim 14, wherein a gear is affixed to the shell plate and engaged with a shell plate motor gear mounted on a shell plate motor, whereby the shell plate is driven by the shell plate motor.

18. The progressive press of claim 14, wherein the plurality of apertures in the tool head have mounted therein one or more dies selected from the group consisting of a primer decapping die, a swage rod for forming a primer pocket, a primer punch for seating a primer in the primer pocket, a sizing die for re-sizing a casing, a neck expansion/flare die, a bullet seating die, and a bullet crimping die.

19. The progressive press of claim 14, further comprising a control system, and wherein the press motor and the shell plate motor are servo motors;

the control system controlling operation of the press motor including rotational direction, quantity and speed of press motor revolutions;

the control system controlling operation of the shell plate motor;

and whereby a selected maximum height and a selected minimum height of the rams and tool head are set by a user using the control system.

20. A progressive press, comprising:

a base having three vertically oriented upper longitudinal cavities positioned at the apices of an equilateral triangle and three vertically-oriented lower cavities aligned with the vertically oriented upper longitudinal cavities;

a vertically-oriented ball nut, having a toothed pulley affixed thereto, retained in each one of the vertically-oriented lower cavities, each ball nut having an upper bearing seated in an upper circular socket in an upper part of a lower cavity and a lower bearing seated in a lower circular socket in a lower part of the lower cavity, whereby each ball nut is retained in and rotatable in its lower cavity;

a vertically-oriented ball screw provided in each one of the ball nuts, the ball screws having an unthreaded cylindrical ram at their upper ends;

a rigid planar tool head, having a plurality of apertures adapted to receive dies and other tools for loading or reloading ammunition, affixed to upper ends of the three cylindrical rams;

a shell plate having a plurality of recesses around a peripheral edge thereof for receiving ammunition casings, a reversible press motor with speed control having a toothed pulley affixed thereto, with a toothed synchronous belt is mounted to and connects the press motor toothed pulley to the ball nut toothed pulleys, wherein operation of the press motor in one direction causes upward travel of the ball screws to extend the rams and tool head to a selected maximum height, and operation of the press motor in another direction causes downward travel of the ball screws to retract the rams and tool head to a selected minimum height;

the shell plate being driven in indexed movement to the extending and retracting of the rams, whereby the shell plate is stationary when the rams are retracted, with a position of at least one recess in the shell plate is aligned with a position of at least one aperture in the tool head, and whereby the shell plate is rotated when the rams are extended, to move the position of the least one recess in the shell plate to a position aligned with another aperture in the tool head;

a control system for controlling operation of the press motor including rotational direction, speed and quantity of motor revolutions, whereby the selected maximum height and selected minimum height of the rams and tool head are set by a user using the control system.

* * * * *